US010559250B2

(12) United States Patent
Chun et al.

(10) Patent No.: US 10,559,250 B2
(45) Date of Patent: Feb. 11, 2020

(54) DISPLAY DEVICE AND DISPLAY METHOD

(71) Applicant: Samsung Display Co., Ltd., Yongin-si, Gyeonggi-do (KR)

(72) Inventors: Byung Ki Chun, Seoul (KR); Jun Gyu Lee, Seoul (KR); Kyung Man Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 155 days.

(21) Appl. No.: 15/911,715

(22) Filed: Mar. 5, 2018

(65) Prior Publication Data

US 2019/0088194 A1 Mar. 21, 2019

(30) Foreign Application Priority Data

Sep. 19, 2017 (KR) ..... 10-2017-0120487

(51) Int. Cl.
*G09G 3/30* (2006.01)

(52) U.S. Cl.
CPC ..... *G09G 3/30* (2013.01); *G09G 2310/0264* (2013.01)

(58) Field of Classification Search
None
See application file for complete search history.

(56) References Cited

U.S. PATENT DOCUMENTS 6,417,835 B1 * 7/2002 Otobe ..... G09G 3/2022 345/690
2011/0227961 A1 * 9/2011 Kikuta ..... G09G 3/3225 345/690
2012/0212500 A1 * 8/2012 Mori ..... G09G 3/007 345/589
2016/0111034 A1 * 4/2016 Lee ..... G09G 3/20 345/213
2016/0189336 A1 * 6/2016 Lee ..... G09G 3/007 345/589
2016/0321973 A1 11/2016 Chun et al.
2016/0329008 A1 11/2016 Chun et al.

FOREIGN PATENT DOCUMENTS

KR 10-2016-0130027 A 11/2016

* cited by examiner

*Primary Examiner* — Chad M Dicke
(74) *Attorney, Agent, or Firm* — Lewis Roca Rothgerber Christie LLP

(57) ABSTRACT

A display device includes a display panel including a plurality of pixels, and a display driver, wherein the image includes at least one X-axis edge pattern in which a difference between gradation values of the two pixels adjacent to each other in an X-axis direction is equal to or greater than a reference gradation value difference, and at least one Y-axis edge pattern in which a difference between gradation values of the two pixels adjacent to each other in a Y-axis direction is equal to or greater than the reference gradation value difference, and degree of movement of some areas of the image in the X-axis direction is greater than degree of movement of some areas of the image in the Y-axis direction when the number of the X-axis edge patterns included in the image is larger than the number of the Y-axis edge patterns included in the image.

18 Claims, 15 Drawing Sheets

| | | |
|---|---|---|
| 254 (P1) | 0 (P2) | 254 (P3) |
| 250 (P4) | 250 (P5) | 250 (P6) |
| 5 (P7) | 5 (P8) | 5 (P9) |

DISPLAY DEVICE AND DISPLAY METHOD

CROSS-REFERENCE TO RELATED APPLICATION

This application claims priority to and the benefit of Korean Patent Application No. 10-2017-0120487, filed on Sep. 19, 2017, the disclosure of which is incorporated herein by reference in its entirety.

BACKGROUND

1. Field

Aspects of some example embodiments of the present invention relate to a display device and a display method.

2. Description of the Related Art

Recently, various kinds of display devices, such as an organic light emitting display device, a liquid crystal display device, and a plasma display device, have been widely used.

Such display devices continuously output a specific image or character for a long time as driving time increases, which may lead to deterioration of pixels in the display device, thereby degrading performance of the display device.

In order to address the above-described problems, a technique (a so-called "pixel shift" technique) for moving and displaying an image on a display panel at regular periods may be utilized. When moving and displaying an image on a display panel at regular periods, it may be possible to prevent (or reduce instances of) the same data from being output to a specific pixel for a long time, thereby reducing instances of pixel deterioration.

A pixel shift technique, for example, may reduce the deterioration of pixels by moving an image in accordance with preset periods and patterns.

The degree of deterioration of pixels may be different for each pattern included in the image, but the prevention (or reduction) of deterioration may be insignificant when the image is moved only in accordance with the preset period and pattern without considering the inputted image.

The above information disclosed in this Background section is only for enhancement of understanding of the background and therefore it may contain information that does not constitute prior art.

SUMMARY

Aspects of some example embodiments of the present invention may include a display device in which an image is variably moved in accordance with the image in order to maximize or improve the degree of prevention (or reduction) of deterioration of pixels.

Aspects of some example embodiments of the present invention may further include a display method in which an image is variably moved in accordance with the image in order to maximize or improve the degree of prevention (or reduction) of deterioration of pixels.

However, aspects of the present invention are not restricted to the one set forth herein. The above and other aspects of the present invention will become more apparent to one of ordinary skill in the art to which the present invention pertains by referencing the detailed description of the present invention given below.

According to some example embodiments, a display device includes: a display panel including a plurality of pixels and configured to display an image; and a display driver unit configured to drive the display panel, wherein the image includes at least one X-axis edge pattern in which a difference between gradation values of the two pixels adjacent to each other in an X-axis direction is equal to or greater than a reference gradation value difference, and at least one Y-axis edge pattern in which a difference between gradation values of the two pixels adjacent to each other in a Y-axis direction is equal to or greater than the reference gradation value difference, and a degree of movement of some areas of the image in the X-axis direction is greater than a degree of movement of some areas of the image in the Y-axis direction when a number of the X-axis edge patterns included in the image is larger than a number of the Y-axis edge patterns included in the image.

According to some example embodiments of the present invention, a display device includes: a display panel including a plurality of pixels; and an image correction unit configured to receive input image data and generating output image data, wherein the image correction unit includes: an edge analysis unit configured to analyze the input image data to detect an X-axis edge pattern and a Y-axis edge pattern of an input image; a scenario determination unit configured to determine a movement pattern of the input image in response to the number of the X-axis edge patterns and the number of the Y-axis edge patterns; and an image data generation unit configured to generate output image data of an output image in which some areas of the input image are moved according to the movement pattern.

According to some example embodiments, the X-axis edge pattern is a pattern in which a difference between gradation values of two pixels adjacent to each other in an X-axis direction is equal to or greater than a reference gradation value difference.

According to some example embodiments, the Y-axis edge pattern is a pattern in which a difference between gradation values of two pixels adjacent to each other in a Y-axis direction is equal to or greater than a reference gradation value difference.

According to some example embodiments, the reference gradation value difference corresponds to 80% of a maximum gradation value.

According to some example embodiments, a degree of movement of the output image in the X-axis direction according to the movement pattern and a degree of movement of the output image in the Y-axis direction according to the movement pattern correspond to the number of X-axis edge patterns in the input image and the number of Y-axis patterns in the input image, respectively.

According to some example embodiments, the degree of movement of the output image in the X-axis direction according to the movement pattern is greater than the degree of movement of the output image in the Y-axis direction according to the movement pattern when the number of the X-axis edge patterns in the input image is larger than the number of the Y-axis edge patterns in the input image.

According to some example embodiments, the degree of movement of the output image in the Y-axis direction according to the movement pattern is greater than the degree of movement of the output image in the X-axis direction according to the movement pattern when the number of the Y-axis edge patterns in the input image is larger than the number of the X-axis edge patterns in the input image.

According to some example embodiments, the image correction unit further includes a frame detection unit configured to analyze the input image data to detect the number of frames of the input image.

According to some example embodiments, the scenario determination unit is configured to determines a lookup table according to the number of the frames, and to determine the movement direction and movement amount of the input image using values included in the lookup table.

According to some example embodiments, the input image and the output image have a same size.

According to some example embodiments, the output image is an image in which a first area of the input image is enlarged, a second area thereof is reduced, and a third area thereof is moved.

According to some example embodiments, the output image is an image in which the third area moves from the first area toward the second area.

According to some example embodiments, the edge analysis unit is configured to detect an X-axis edge pattern and a Y-axis edge pattern only in some areas of the input image.

According to some example embodiments, the edge analysis unit is configured to detect an X-axis edge pattern and a Y-axis edge pattern only in some frames of the input image.

According to some example embodiments, the edge analysis unit is configured to detect a diagonal edge pattern of the input image.

According to some example embodiments, the diagonal edge pattern is a pattern in which a difference between gradation values of two pixels adjacent to each other in a diagonal direction is equal to or greater than a reference gradation value difference.

According to some example embodiments of the present invention, in a display method, the method includes: analyzing input image data to detect an X-axis edge pattern and a Y-axis edge pattern of an input image; determining a movement pattern of the input image in response to the number of the X-axis edge patterns and the number of the Y-axis edge patterns; and generating output image data of an output image in which some areas of the input image are moved according to the movement pattern.

According to some example embodiments, the detecting of the X-axis edge pattern includes: selecting a comparative pixel set; determining whether a difference in gradation vales between the comparative pixel sets is equal to or greater than a reference gradation value difference; counting the number of the X-axis edge patterns when the difference in gradation vales between the comparative pixel sets is equal to or greater than the reference gradation value difference; and determining whether or not the last pixel is included in the comparative pixel set.

According to some example embodiments, the reference gradation value difference corresponds to 80% of a maximum gradation value.

BRIEF DESCRIPTION OF THE DRAWINGS

The above and other aspects and features of the present invention will become more apparent by describing in detail aspects of example embodiments thereof with reference to the attached drawings, in which.

DETAILED DESCRIPTION

Aspects of some example embodiments of the present invention will now be described more fully hereinafter with reference to the accompanying drawings, in which example embodiments of the invention are shown. This invention may, however, be embodied in different forms and should not be construed as limited to the embodiments set forth herein. Rather, these embodiments are provided so that this disclosure will be more thorough and more complete, and will more fully convey the scope of the invention to those skilled in the art. The same reference numbers indicate the same components throughout the specification. In the attached figures, the thickness of layers and regions is exaggerated for clarity.

It will be understood that, although the terms first, second, third, etc., may be used herein to describe various elements, these elements should not be limited by these terms. These terms are only used to distinguish one element from another element. Thus, a first element discussed below could be termed a second element without departing from the teachings of the invention.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Hereinafter, aspects of example embodiments of the present invention will be described with reference to the attached drawings.

Figure 1:
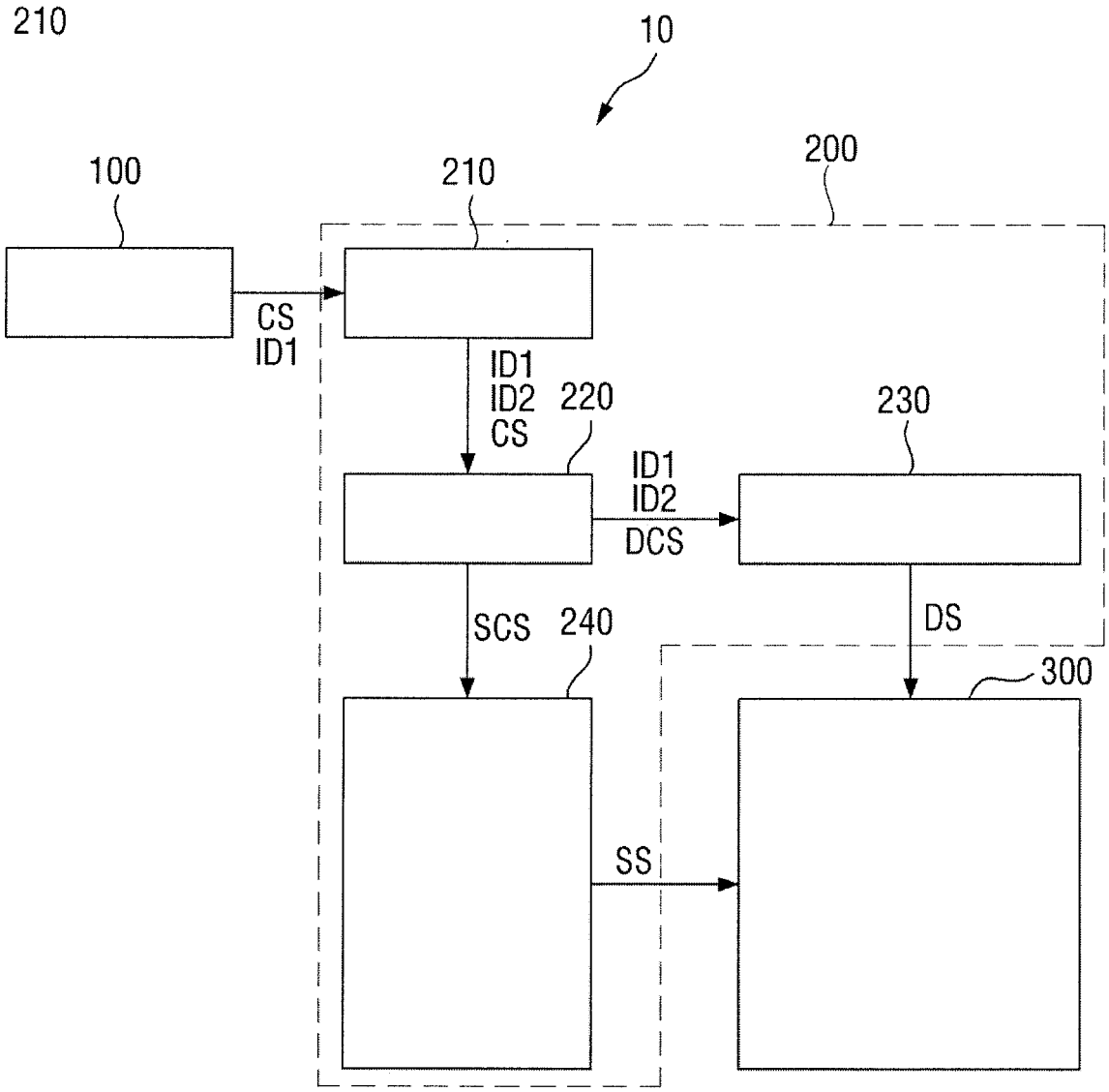
FIG. 1 is a block diagram of a display device according to some example embodiments of the present invention.

FIG. 1 is a block diagram of a display device according to an embodiment.

Referring to FIG. 1, a display device 10 according to an embodiment includes a processor 100, a display driving unit (or display driver) 200, and a display panel 300.

The processor 100 provides first image data ID1 and a control signal CS to the display driving unit 200.

Illustratively, the processor 100 may be realized as an integrated circuit (IC), an application processor (AP), a mobile AP, or the like.

Illustratively, the control signal CS may include a vertical synchronization signal, a horizontal synchronization signal, a data enable signal, and a clock signal.

The display driving unit 200 includes an image correction unit (or image corrector) 210, a signal control unit (or signal controller) 220, a data driving unit (or data driver) 230, and a scan driving unit (or scan driver) 240.

The image correction unit 210 may generate second image data ID2 using the first image data ID1 and control signal CS provided from the processor 100. Further, the image correction unit 210 may provide the first image data ID1, the second image data ID2, and the control signal CS to the signal control unit 220. Here, the second image data ID2 may refer to data obtained by converting the first image data ID1 using a pixel shift technique.

In some embodiments, the image correcting unit 210 may directly provide the first image data ID1, the second image data ID2, and the control signal CS to the data driving unit 230 without passing through the signal control unit 220. Further, the image correcting unit 210 may be separately disposed from (e.g., external with respect to) the display driving unit 200. Further, the image correction unit 210 may also be incorporated in the signal control unit 220, and, in this case, the signal control unit 220 may convert the first image data ID1 into the second image data ID2.

The signal control unit 220 may receive the first image data ID1, the second image data ID2, and the control signal CS from the image correction unit 210.

The signal control unit 220 may generate a scan timing control signal SCS for controlling the scan driving unit 240 and a data timing control signal DCS for controlling the data driving unit 230, based on the control signal CS.

The data driving unit 230 may receive the data timing control signal DCS, the first image data ID1, and the second image data ID2 from the signal control unit 220 and generate a data signal DS. The generated data signal DS may be provided to data lines mounted in the display panel 300. In some embodiments, the data driving unit 230 may also be directly mounted in the display panel 300.

The scan driving unit 240 may provide a scan signal SS to scan lines mounted in the display panel 300 in response to the scan timing control signal SCS. In some embodiments, the scan driving unit 240 may also be directly mounted in the display panel 300.

Each pixel of the display panel 300 having received the data signal DS through the data lines may emit light with luminance corresponding to the scan signal SS and the data signal DS.

For example, when the signal control unit 220 or the image correction unit 210 provides the first image data ID1 to the data driving unit 230, the data driving unit 230 provides the data signal DS corresponding to the first image data ID1 to the display panel 300, and thus each of the pixels of the display panel 300 may display an image realized by the first image data ID1.

Further, when the signal control unit 220 or the image correction unit 210 provides the second image data ID2 to the data driving unit 230, the data driving unit 230 provides the data signal DS corresponding to the second image data ID2 to the display panel 300, and thus each of the pixels of the display panel 300 may display an image realized by the second image data ID2.

The display panel includes a plurality of pixels. The display panel 300 may display an image using the plurality of pixels emitting light according to the control of the display driving unit 200. Illustratively, the display panel 300 may be realized as an organic light emitting display panel, a liquid crystal display panel, a plasma display panel, or the like, but the present invention is not limited thereto.

Figure 2:
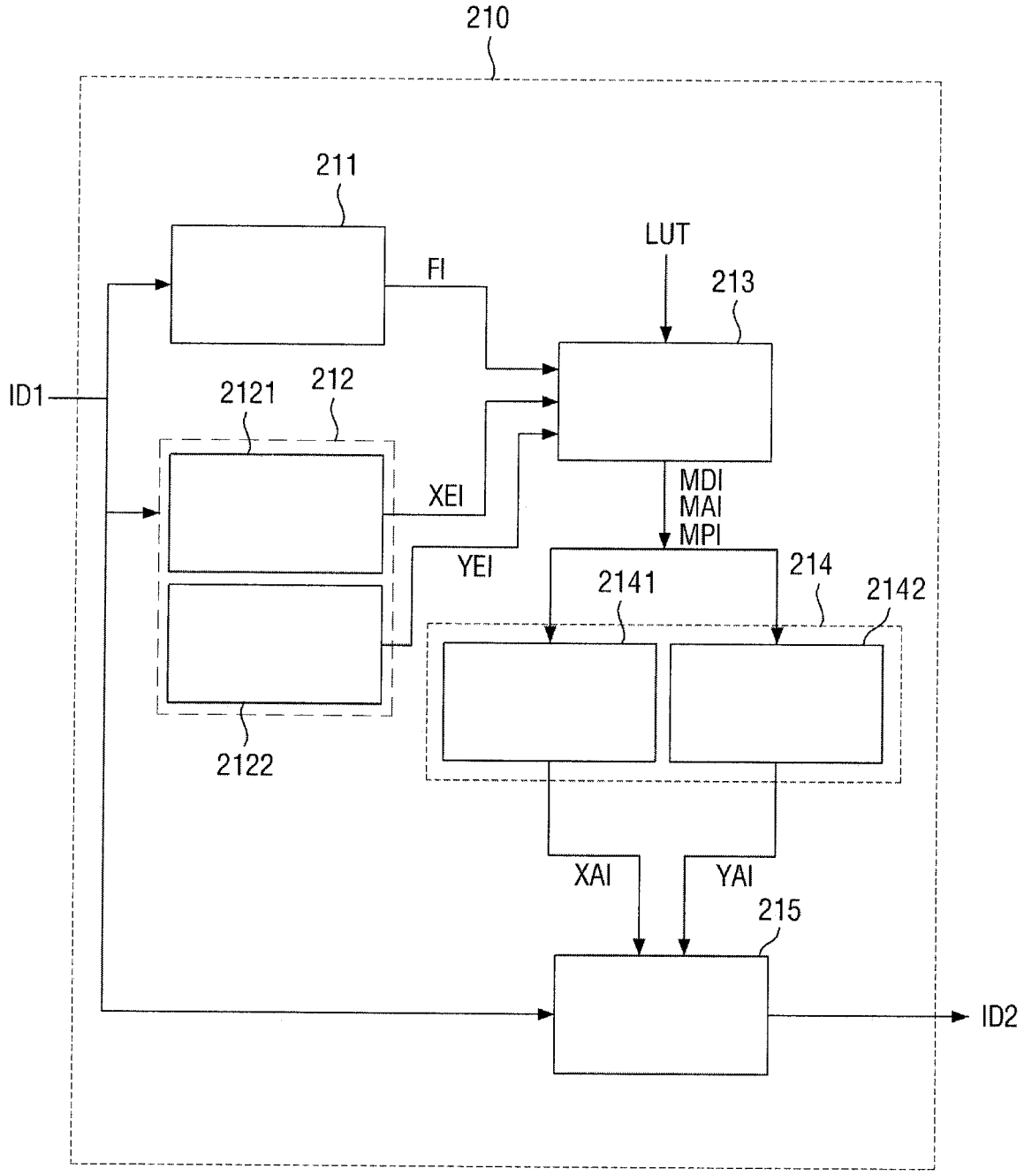
FIG. 2 is a block diagram of an image correction unit according to some example embodiments of the present invention.

FIG. 2 is a block diagram of an image correction unit according to an embodiment.

Referring to FIG. 2, the image correction unit 210 includes a frame detection unit (or frame detector) 211, an edge analysis unit (or edge analyzer) 212, a scenario determination unit (or scenario determiner) 213, an area determination unit (or area determiner) 214, and an image data generation unit (or image data generator) 215.

The frame detection unit 211 may calculate frame information FI. In this case, the frame detection unit 211 may calculate the order of frames of the currently provided first image data ID1 by using some of the control signals CS supplied from the processor 100, for example, a vertical synchronization signal.

The frame detection unit 211 may provide the frame information FI to the scenario determination unit 213.

The edge analysis unit 212 may detect the number of X-axis edge patterns and Y-axis edge patterns included in each frame of the image realized by the first image data ID1. A more detailed description of the X-axis edge pattern and the Y-axis edge pattern will be described later.

For example, the edge analysis unit 212 includes an X-axis counter 2121 and a Y-axis edge counter 2122.

The X-axis edge counter 2121 may detect the number of X-axis edge patterns included in each frame, and may provide X-axis edge pattern information XEI including information about the number of X-axis edge patterns to the scenario determination unit 213.

Further, the Y-axis edge counter 2122 may detect the number of Y-axis edge patterns included in each frame, and may provide Y-axis edge pattern information YEI including information about the number of Y-axis edge patterns to the scenario determination unit 213.

The scenario determination unit 213 may determine the movement direction, movement amount and movement pattern of an image. For example, the scenario determination unit 213 may determine an X-axis movement direction, a Y-axis movement direction, an X-axis movement amount, a Y-axis movement amount, and a movement pattern.

The scenario determination unit 213 may generate image movement direction information MDI including information about the movement direction of the determined image. Further, the scenario determination unit 213 may generate image movement amount information MAI including information about the movement amount of the determined image. Moreover, the scenario determination unit 213 may generate image movement pattern information MPI including information about the movement pattern of the determined image.

For example, the scenario determination unit 213 may determine an X-axis movement direction, a Y-axis movement direction, an X-axis movement amount, a Y-axis movement amount, and a movement pattern by using the frame information FI received from the frame detection unit 211 and the X-axis edge pattern information XEI and Y-axis edge pattern information YEI received from the edge analysis unit 212. The X-axis edge pattern and the Y-axis edge pattern will be described in more detail later.

In an embodiment, the scenario determination unit 213 may generate a lookup table LUT including information about the movement direction, movement amount and movement pattern of an image, and may determine the movement direction, movement amount and movement pattern of an image using the generated lookup table.

In some embodiments, the scenario determination unit 213 may determine the movement direction, movement amount and movement pattern of an image using external transmission or the previously stored lookup table LUT.

The area determination unit 214 may include an X-axis area determination unit 2141 and a Y-axis area determination unit 2142.

The X-axis area determination unit 2141 may determine an X-axis area using the image movement direction information MDI, the image movement amount information MAI, and the image movement pattern information MPI, and may generate X-axis area information XAI about the determined X-axis area. The X-axis area may include an X-axis reduction area, an X-axis enlargement area, and an X-axis movement area.

The Y-axis area determination unit 2142 may determine a Y-axis area using the image movement direction information MDI, the image movement amount information MAI, and the image movement pattern information MPI, and may generate Y-axis area information YAI about the determined Y-axis area. The Y-axis area may include a Y-axis reduction area, a Y-axis enlargement area, and a Y-axis movement area.

The image data generation unit 215 may generate the second image data ID2 using the X-axis area information XAI and the Y-axis area information YAI.

Hereinafter, the movement of an image will be described in more detail.

Figure 3:
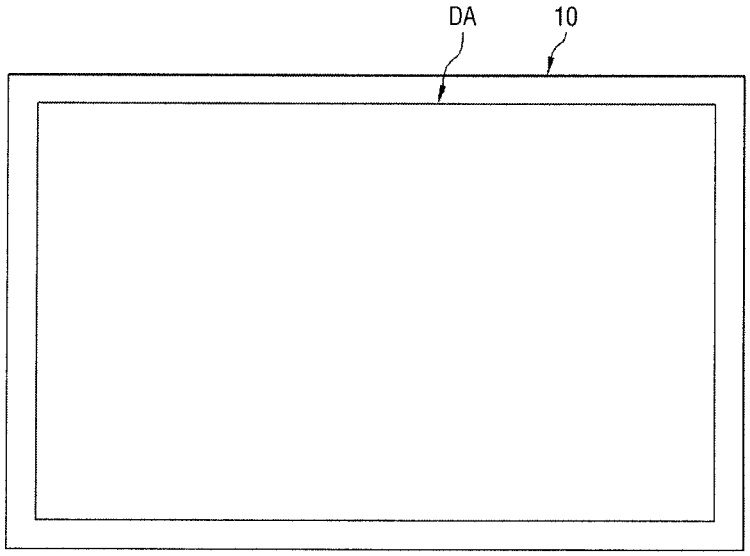
FIG. 3 is a schematic view illustrating a display area of the display device according to some example embodiments of the present invention.

FIG. 3 is a schematic view illustrating a display area of the display device according to an embodiment.

Referring to FIG. 3, a display device according to an embodiment includes a display area DA displaying an image (or where an image may be displayed).

The display device 10, which is a device for providing a predetermined image to a user, may display an image on the display area DA. The user of the display device can visually recognize the image displayed on the display area DA.

Figure 4:
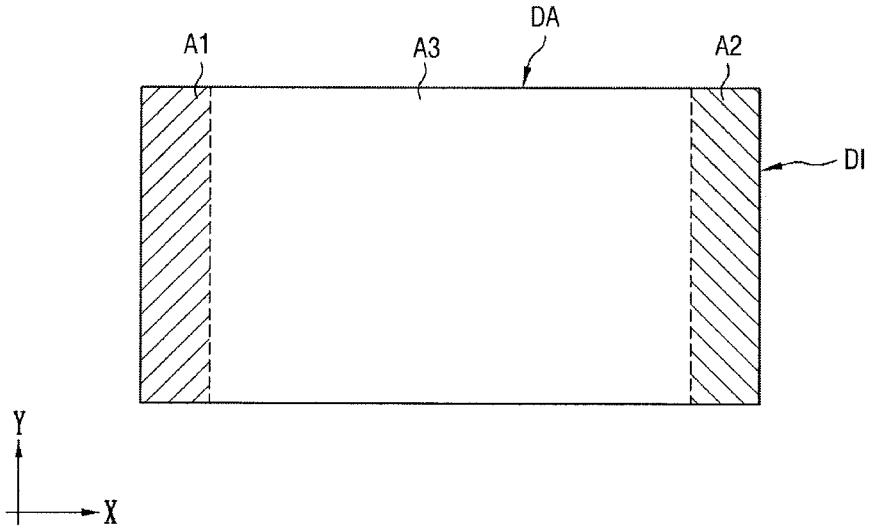
FIGS. 4 and 5 are conceptual views illustrating image movement in the X-axis direction of the display device according to some example embodiments of the present invention.
Figure 5:
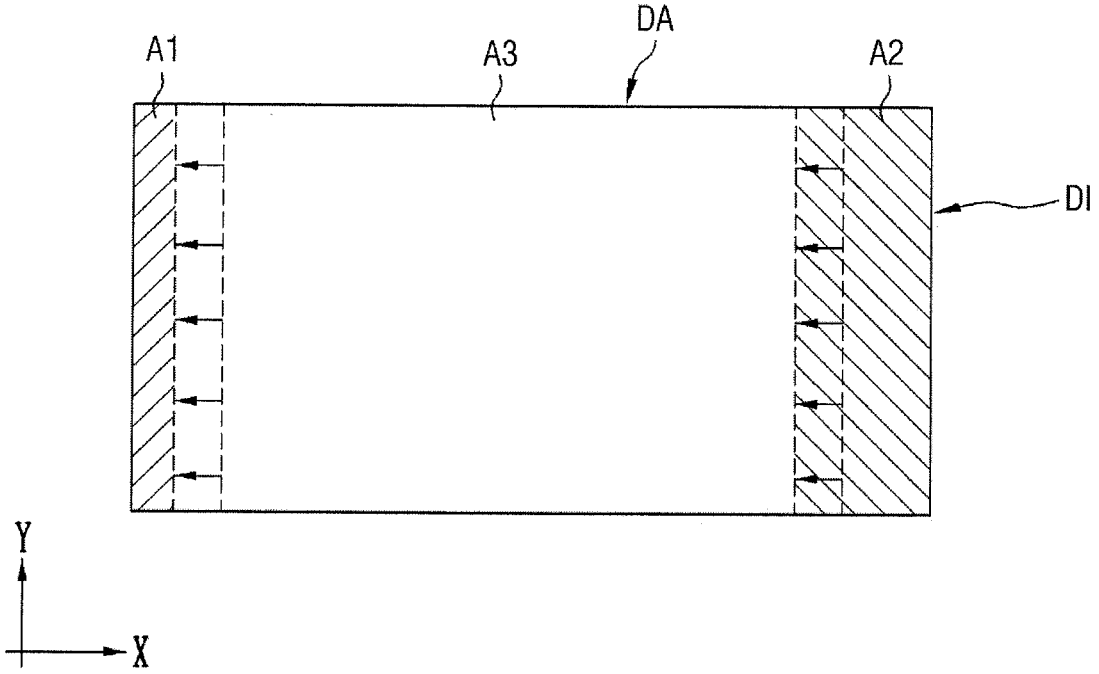

FIGS. 4 and 5 are conceptual views illustrating the image movement in the X-axis direction of the display device according to the embodiment.

Referring to FIGS. 4 and 5, the display device 10 may display a display image DI on the display area DA for several frame periods. Here, the size of the display image DI may be set to be equal to or smaller than that of the display area DA.

The display image DI may include a plurality of areas. For example, the display image DI may include a first area A1, a second area A2, and a third area A3. The first area A1, the second area A2, and the third area A3 may be sequentially arranged in this order along the X-axis direction X. In other words, when determining the order along the X-axis direction X, the third area A3 may be an area arranged between the first area A1 and the second area A2. Referring to FIGS. 4 and 5, the first area A1 may be an area at the left side of the third area A3, and the second area A2 may be an area at the right side of the third area A3.

Here, the X-axis direction X refers to a direction indicated by a straight line extending in one direction in the display area DA, and refers to a direction orthogonal to the Y-axis direction Y. Referring to FIGS. 4 and 5, the X-axis direction X may be defined as a direction indicated by an arbitrary straight line extending from the left side to the right side. In some embodiments, the X-axis direction X may be defined as a direction in which the row of each pixel arranged in the display area DA increases. Thus, the Y-axis direction Y may be defined as a direction indicated by an arbitrary straight line extending from the upper side to the lower side. In some embodiments, referring to FIGS. 4 and 5, the Y-axis direction Y may be defined as a direction in which the column of each pixel arranged in the display area DA increases.

FIG. 4 schematically illustrates the display image DI displayed on the display area DA during the first frame period, and FIG. 5 schematically illustrates the display image DI displayed on the display area DA during the second frame period.

Here, the first frame period means a period in which at least one frame is displayed, and the second frame period means a period which is subsequent to the first frame period and in which at least one frame is displayed.

The display image DI displayed during the first frame period may be displayed in a form shifted in a direction opposite to the X axis direction X in the second frame period. In other words, the first area A1, second area A2, and third area A3 of the display image DI having been displayed during the first frame period may be displayed in a form in which some areas are deformed in the second frame period.

For example, the first area A1 may be enlarged in a direction opposite to the X-axis direction X during the second frame period compared to during the first frame period, and the second area A2 may be reduced in a direction opposite to the X-axis direction X during the second frame period compared to during the first frame period. The third area A3 may be moved in a direction opposite to the X-axis direction X during the second frame period compared to during the first frame period. However, the total area of the first area A1, the second area A2, and the third area A3 may be maintained equally during the first frame period and the second frame period.

As described above, the display image DI is enlarged, reduced, and moved for each area, thereby preventing (or reducing) the occurrence of afterimages and minimizing (or reducing) the deterioration of the display device 10.

FIGS. 4 and 5 illustrate a case where the display image DI moves in a direction opposite to the X-axis direction X, but, of course, the display image DI can move in the X-axis direction. In this case, the first area A1 may be reduced in the X-axis direction, the second area A2 may be enlarged in the X-axis direction, and the third area A3 may be moved in the X-axis direction.

Figure 6:
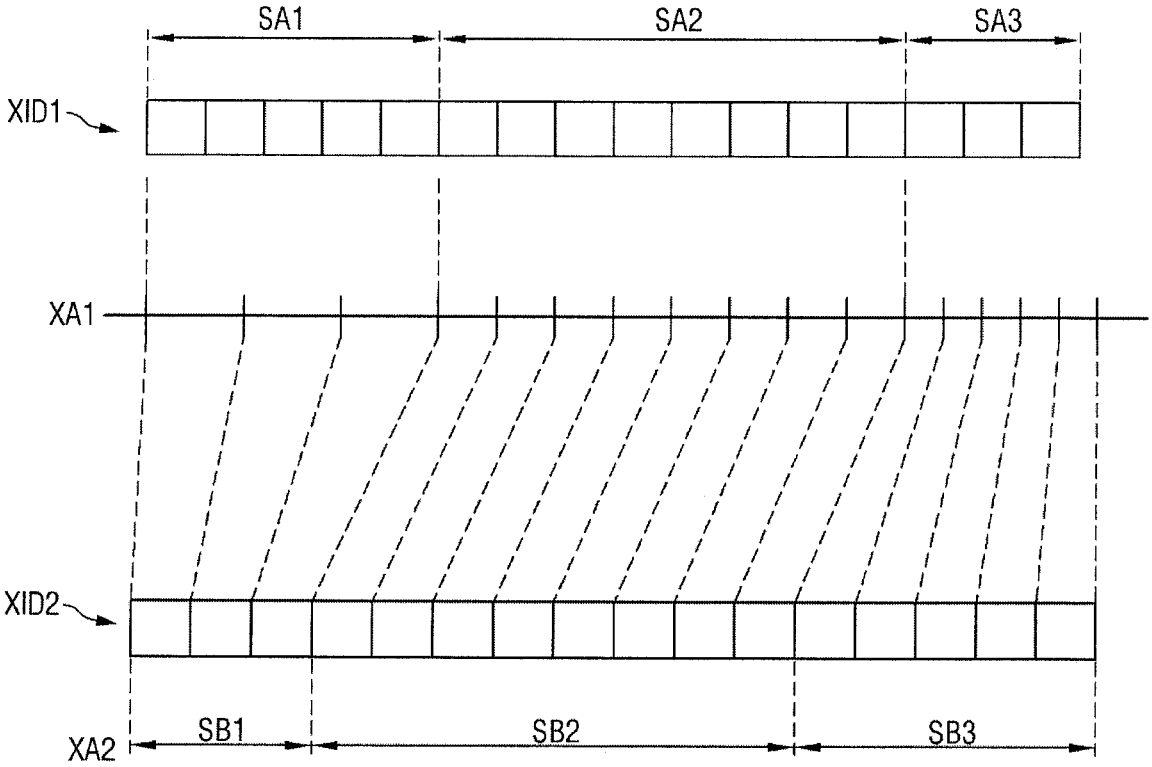
FIG. 6 is a conceptual view for explaining a method of generating image data moved in the X-axis direction of the image correction unit according to some example embodiments of the present invention.

FIG. 6 is a conceptual view for explaining a method of generating image data moved in the X-axis direction of the image correction unit according to an embodiment.

For the convenience of explanation, FIG. 6 shows the first X-axis image data XID1 and second X-axis image data XID2 associated with one row among the pixels arranged in a matrix form. Here, the first X-axis image data XID1 may correspond to a part of the first image data ID1, and the second X-axis image data XID2 may correspond to a part of the second image data ID2.

The X-axis area determination unit 2141 may divide the display image DI into sub-areas SA1, SA2, and SA3 before movement along the X-axis direction X. Here, the X-axis area XA1 before movement may include sub-areas SA1, SA2, and SA3 before movement.

Further, the X-axis area XA2 after movement may include sub-areas SB1, SB2, and SB3 after movement corresponding to the data after the display image DI has moved.

Illustratively, the X-axis area determination unit 214 may determine the image displayed on the pixel located at the fifth position in the right direction from the pixel located at the leftmost position as a first sub-area SA1 before movement, may determine the image displayed on the pixel located at the third position in the left direction from the pixel located at the rightmost position as a second sub-area SA2 before movement, and may determine a third sub-area SA3 before movement located between the first sub-area SA1 before movement and the second sub-area SA2 before movement.

The image data generation unit 215 may convert the first X-axis image data XID1 displaying the sub-areas SA1, SA2, and SA3 before movement into the second X-axis image data XID2 so as to display the sub-areas SB1, SB2, and SB3 after movement.

For example, the image data generation unit 215 may convert the first X-axis image data XID1 displaying the first sub-area SA1 before movement into the second X-axis image data XID2 so as to display the first sub-area SB1 after movement.

Further, the image data generation unit 215 may convert the first X-axis image data XID1 displaying the second sub-area SA2 before movement into the second X-axis image data XID2 so as to display the second sub-area SB2 after movement.

Further, the image data generation unit 215 may convert the first X-axis image data XID1 displaying the third sub-area SA3 before movement into the second X-axis image data XID2 so as to display the third sub-area SB3 after movement.

Hereinafter, the reduction of an image will be described in more detail.

The X-axis area determination unit 2141 may determine the first area SB1 after movement reduced compared to the first area SA1 before movement using the image movement direction information MDI and image movement amount information MAI generated from the scenario determination unit 213.

For example, when the image movement direction information MDI is set in a direction opposite to the X-axis direction and the image movement amount information MAI is set to the movement of n pixels (n is a positive number), the X-axis area determination unit 2141 may set the first sub-area SB1 after movement, reduced by n pixels in a direction opposite to the X-axis direction X, compared to the first sub-area SA1 before movement.

Then, for image reduction, the image data generation unit 215 may convert an image displayed on p pixels (p is a positive number) of the first sub-area SA1 before movement into an image displayed on q pixels (q is a positive number) of the first sub-area SB1 after movement.

That is, the image data generation unit 215 may convert data to be provided as p pixels into data to be provided as q pixels.

Because an image displayed on p pixels is displayed on q pixels, the image displayed on the first sub-area SB1 after movement may be displayed in a reduction ratio of k than the image displayed on the first sub-area SA1 before movement (here, $k=q/p$).

Hereinafter, the enlargement of an image will be described in more detail.

The X-axis area determination unit 2141 may determine the second sub-area SB2 after movement enlarged compared to the second sub-area SA2 before movement using the image movement direction information MDI and image movement amount information MAI generated from the scenario determination unit 213.

For example, when the image movement direction information MDI is set in a direction opposite to the X-axis direction and the image movement amount information MAI is set to the movement of n pixels (n is a positive number), the X-axis area determination unit 2141 may set the second sub-area SB2 after movement, enlarged by n pixels in a direction opposite to the X-axis direction X, compared to the second sub-area SA2 before movement.

Then, for image enlargement, the image data generation unit 215 may convert an image displayed on r pixels (r is a positive number) of the second sub-area SA2 before movement into an image displayed on s pixels (s is a positive number) of the second sub-area SB2 after movement.

That is, the image data generation unit 215 may convert data to be provided as r pixels into data to be provided as s pixels.

Because an image displayed on r pixels is displayed on s pixels, the image displayed on the second sub-area SB2 after movement may be displayed in a reduction ratio of 1 than the image displayed on the second sub-area SA2 before movement (here, $I=s/r$).

Hereinafter, the movement of an image will be described in more detail.

The X-axis area determination unit 2141 may determine the third sub-area SB3 after movement moved compared to the third sub-area SA3 before movement using the image movement direction information MDI and image movement amount information MAI generated from the scenario determination unit 213.

For example, when the image movement direction information MDI is set in a direction opposite to the X-axis direction and the image movement amount information MAI is set to the movement of n pixels (n is a positive number), the X-axis area determination unit 2141 may set the third sub-area SB3 after movement, moved by n pixels in a direction opposite to the X-axis direction X, compared to the third sub-area SA3 before movement.

Then, for image movement, the image data generation unit 215 may convert an image displayed on t pixels (t is a positive number) of the third sub-area SA3 before movement into an image displayed on t pixels of the third sub-area SB3 after movement. That is, the image data generation unit 215 may convert the position of the image.

Figure 7:
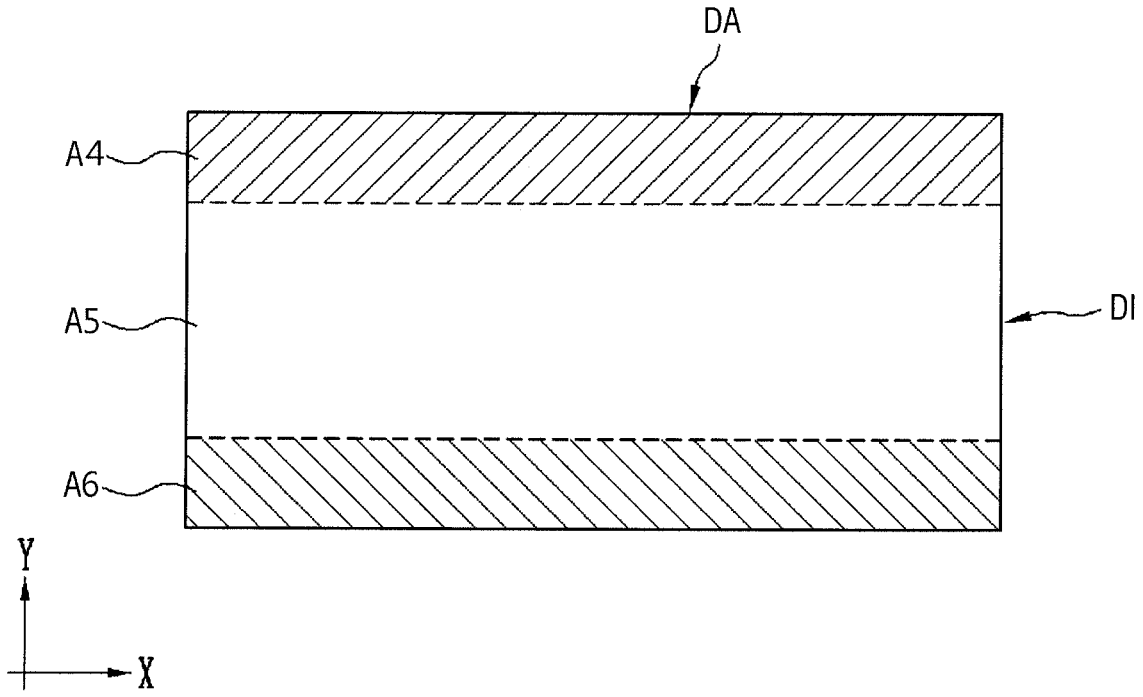
FIGS. 7 and 8 are conceptual views illustrating image movement in the Y-axis direction of the display device according to some example embodiments of the present invention.
Figure 8:
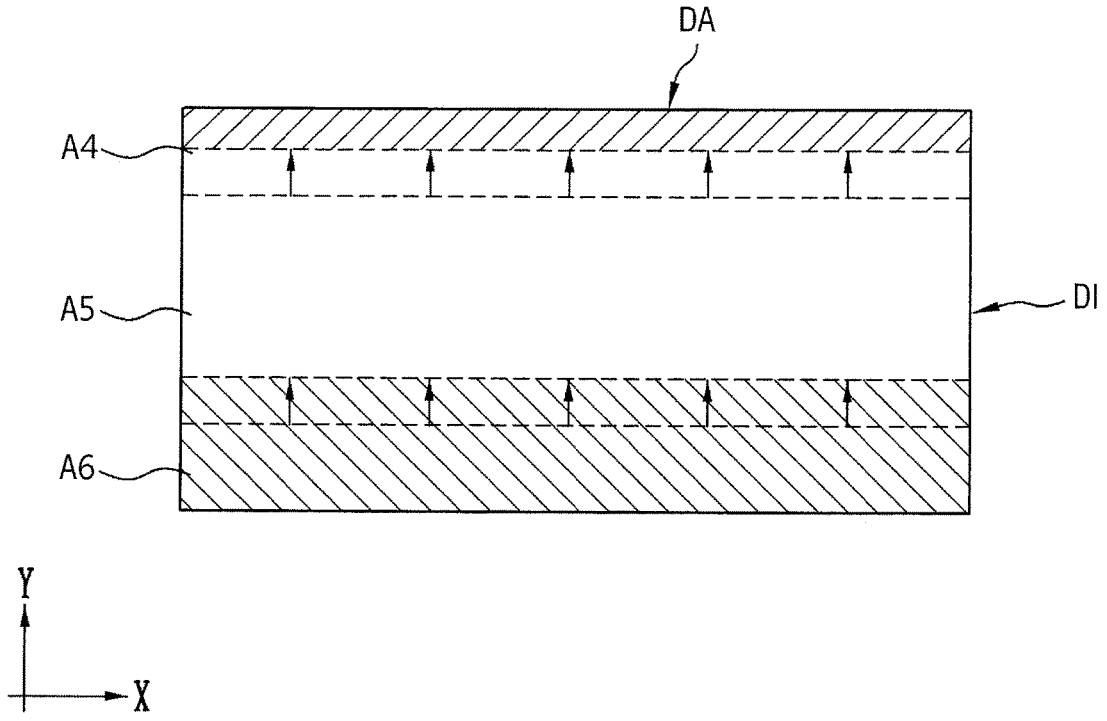

FIGS. 7 and 8 are conceptual views illustrating the image movement in the Y-axis direction of the display device according to the embodiment.

Referring to FIGS. 7 and 8, the display device 10 may display a display image DI on the display area DA for several frame periods. Here, the size of the display image DI may be set to be equal to or smaller than that of the display area DA.

The display image DI may include a plurality of areas. For example, the display image DI may include a fourth area A4, a fifth area A5, and a sixth area A6. The fourth area A4, the fifth area A5, and the sixth area A6 may be sequentially arranged in this order along the Y-axis direction Y. In other words, when determining the order along the Y-axis direction Y, the sixth area A6 may be an area between the fourth area A4 and the fifth area A5. Referring to FIGS. 7 and 8, the fourth area A4 may be an area at the upper side of the sixth area A6, and the fifth area A5 may be an area at the lower side of the sixth area A6.

FIG. 7 schematically illustrates the display image DI displayed on the display area DA during the third frame period, and FIG. 8 schematically illustrates the display image DI displayed on the display area DA during the fourth frame period.

Here, the third frame period means a period in which at least one frame is displayed, and the fourth frame period means a period which is subsequent to the third frame period and in which at least one frame is displayed.

The display image DI displayed during the third frame period may be displayed in a form shifted in the Y-axis direction X in the fourth frame period. In other words, the fourth area A4, fifth area A5 and sixth area A6 of the display image DI having been displayed during the third frame period may be displayed in a form in which some areas are deformed in the fourth frame period.

For example, the fourth area A4 may be reduced in the Y-axis direction X during the fourth frame period compared to during the third frame period, and the fifth area A5 may be enlarged in the Y-axis direction Y during the fourth frame period compared to during the third frame period. The sixth area A6 may be moved in the Y-axis direction Y during the fourth frame period compared to during the third frame period. However, the total area of the fourth area A4, the fifth area A5, and the sixth area A6 may be maintained equally during the third frame period and the fourth frame period.

As described above, the display image DI is enlarged, reduced, and moved for each area, thereby preventing (or reducing) the occurrence of afterimages and minimizing (or reducing) the deterioration of the display device 10.

FIGS. 7 and 8 illustrate a case where the display image DI moves in the Y-axis direction, but, of course, the display image DI may move in in a direction opposite to the Y-axis direction Y. In this case, the fourth area A4 may be reduced in a direction opposite to the Y-axis direction Y, and the fifth area A5 may be enlarged in a direction opposite to the Y-axis direction Y, and the sixth area A6 may be moved in a direction opposite to the Y-axis direction Y.

Figure 9:
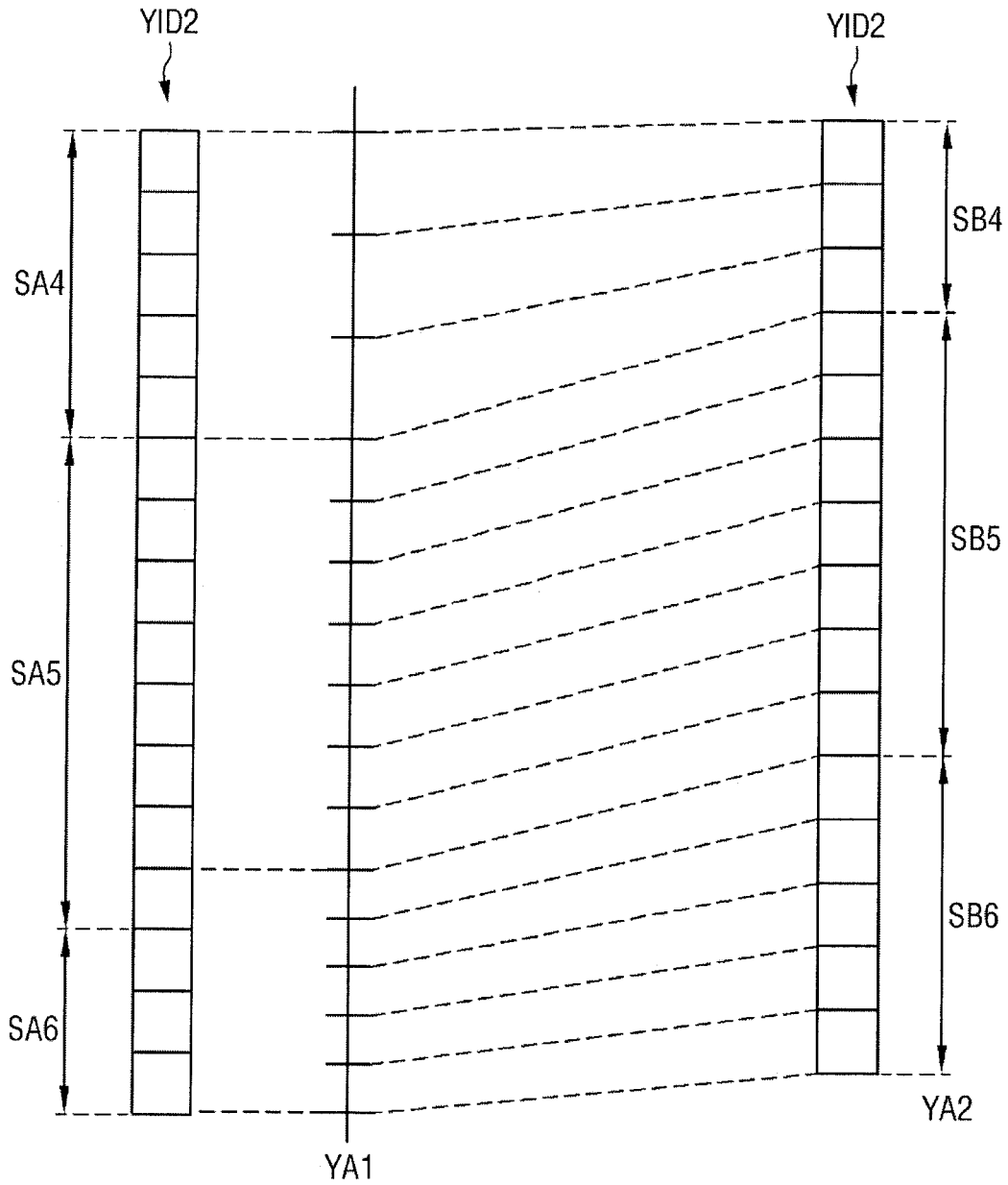
FIG. 9 is a conceptual view for explaining a method of generating image data moved in the Y-axis direction of the image correction unit according to some example embodiments of the present invention.

FIG. 9 is a conceptual view for explaining a method of generating image data moved in the Y-axis direction of the image correction unit according to an embodiment.

For the convenience of explanation, FIG. 9 shows the first Y-axis image data YID1 and second Y-axis image data YID2 associated with one row among the pixels arranged in a matrix form. Here, the first Y-axis image data YID1 may correspond to a part of the first image data ID1, and the second Y-axis image data YID2 may correspond to a part of the second image data ID2.

The Y-axis area determination unit 2142 may divide the display image DI into sub-areas SA4, SA5, and SA6 before movement along the Y-axis direction Y. Here, the Y-axis area YA1 before movement may include sub-areas SA4, SA5, and SA6 before movement.

Further, the Y-axis area YA2 after movement may include sub-areas SB4, SB5, and SB6 after movement corresponding to the data after the display image DI has moved.

For example, the X-axis area determination unit 2142 may determine the image displayed on the pixel located at the fifth position in the lower direction from the pixel located at the uppermost position as a fourth area SA4 before movement, may determine the image displayed on the pixel located at the third position in the upper direction from the pixel located at the lowermost position as a fifth area SA5 before movement, and may determine a sixth area SA6 before movement located between the fourth area SA4 before movement and the fifth area SA5 before movement.

The image data generation unit 215 may convert the first Y-axis image data YID1 displaying the sub-areas SA4, SA5, and SA6 before movement into the second Y-axis image data YID2 so as to display the sub-areas SB4, SB5, and SB6 after movement.

For example, the image data generation unit 215 may convert the first Y-axis image data YID1 displaying the fourth sub-areas SA4 before movement into the second Y-axis image data YID2 so as to display the fourth sub-area SB4 after movement.

Further, the image data generation unit 215 may convert the first Y-axis image data YID1 displaying the fifth sub-area SA5 before movement into the second Y-axis image data YID2 so as to display the fifth sub-area SB5 after movement.

Further, the image data generation unit 215 may convert the first Y-axis image data YID1 displaying the sixth sub-area SA6 before movement into the second Y-axis image data YID2 so as to display the sixth sub-area SB6 after movement.

Hereinafter, the reduction of an image will be described in more detail.

The Y-axis area determination unit 2142 may determine the fourth area SB4 after movement reduced compared to the fourth area SA4 before movement using the image movement direction information MDI and image movement amount information MAI generated from the scenario determination unit 213.

For example, when the image movement direction information MDI is set in the Y-axis direction and the image movement amount information MAI is set to the movement of n pixels (n is a positive number), the Y-axis area determination unit 2142 may set the fourth area SB4 after movement, reduced by n pixels in the Y-axis direction Y, compared to the fourth area SA4 before movement.

Then, for image reduction, the image data generation unit 215 may convert an image displayed on p pixels (p is a positive number) of the fourth area SA4 before movement into an image displayed on q pixels (q is a positive number) of the fourth area SB4 after movement.

That is, the image data generation unit 215 may convert data to be provided as p pixels into data to be provided as q pixels.

Because an image displayed on p pixels is displayed on q pixels, the image displayed on the fourth area SB4 after movement may be displayed in a reduction ratio of k than the image displayed on the first area SA1 before movement (here, k=q/p).

Hereinafter, the enlargement of an image will be described in more detail.

The Y-axis area determination unit 2142 may determine the fifth area SB5 after movement enlarged compared to the fifth area SA5 before movement using the image movement direction information MDI and image movement amount information MAI generated from the scenario determination unit 213.

For example, when the image movement direction information MDI is set in the Y-axis direction and the image movement amount information MAI is set to the movement of n pixels (n is a positive number), the Y-axis area determination unit 2142 may set the fifth area SB5 after movement, enlarged by n pixels in the X-axis direction X, compared to the fifth area SA5 before movement.

Then, for image enlargement, the image data generation unit 215 may convert an image displayed on r pixels (r is a positive number) of the fifth area SA5 before movement into an image displayed on s pixels (s is a positive number) of the fifth area SB5 after movement.

That is, the image data generation unit 215 may convert data to be provided as r pixels into data to be provided as s pixels.

Because an image displayed on r pixels is displayed on s pixels, the image displayed on the fifth area SB5 after movement may be displayed in a reduction ratio of I than the image displayed on the fifth area SA5 before movement (here, I=s/r).

Hereinafter, the movement of an image will be described in more detail.

The Y-axis area determination unit 2142 may determine the sixth area SB6 after movement moved compared to the sixth area SA6 before movement using the image movement direction information MDI and image movement amount information MAI generated from the scenario determination unit 213.

For example, when the image movement direction information MDI is set in the Y-axis direction and the image movement amount information MAI is set to the movement of n pixels (n is a positive number), the Y-axis area determination unit 2141 may set the sixth area SB6 after movement, moved by n pixels in the Y-axis direction Y, compared to the sixth area SA6 before movement.

Then, for image movement, the image data generation unit 215 may convert an image displayed on t pixels (t is a positive number) of the sixth area SA6 before movement into an image displayed on t pixels of the sixth area SB6 after movement. That is, the image data generation unit 215 may convert the position of the image.

Hereinafter, the X-axis edge pattern and the Y-axis edge pattern will be described in more detail with reference to FIG. 10.

Figure 10:
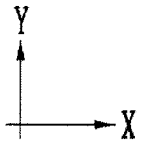
FIG. 10 is a schematic view illustrating an image realized by first image data according to some example embodiments of the present invention.

FIG. 10 is a schematic view illustrating an image realized by first image data according to an embodiment.

In FIG. 10, the first image data ID1 provided to the display device 10 including the display area DA composed of pixels P1 to P9 arranged in a matrix form of 3×3 will be assumed. Further, it is assumed that the minimum gradation value of each pixel is 0 and the maximum gradation value thereof is 254. This will be expressed for each pixel.

That is, FIG. 10 illustrates a case where the first pixel P1 has a gradation value of 254, the second pixel P1 has a gradation value of 0, the third pixel P3 has a gradation value of 254, each of the fourth pixel P4, the fifth pixel P5 and the sixth pixel P6 has a gradation value of 250, and each of the seventh pixel P7, the eighth pixel P8 and the ninth pixel P9 has a gradation value of 5.

Referring to FIG. 10, the X-axis edge pattern may be defined as a case where the difference between the gradation values of two pixels adjacent to each other in the X-axis direction X is equal to or greater than the reference gradation value difference. Similarly, the Y-axis edge pattern may be defined as a case where the difference between the gradation values of two pixels adjacent to each other in the Y-axis direction Y is equal to or greater than the reference gradation value difference.

Here, the reference gradation value difference may be a preset value, and, illustratively, may be defined as 80% or more of the maximum gradation value.

For example, in the embodiment according to FIG. 10, when the difference between the gradation values of two pixels adjacent to each other in the X-axis direction X is 204 or more, which is about 80% or more of the maximum gradation value of 255, it may be determined as one edge pattern.

Accordingly, the difference between the gradation values of the first pixel P1 and the second pixel P2 is 254, which may be detected as one X-axis edge pattern. Further, the difference between the gradation values of the second pixel P2 and the third pixel P3 is 254, which may be detected as one X-axis edge pattern.

Further, in the embodiment according to FIG. 10, when the difference between the gradation values of two pixels adjacent to each other in the Y-axis direction Y is 204 or more, which is about 80% or more of the maximum gradation value of 255, it may be determined as one edge pattern.

Accordingly, the difference between the gradation values of the second pixel P2 and the fifth pixel P5 is 250, which may be detected as one Y-axis edge pattern. Further, the difference between the gradation values of the fourth pixel P4 and the seventh pixel P7 is 245, which may be detected as one Y-axis edge pattern. Further, the difference between the gradation values of the fifth pixel P5 and the sixth pixel P6 is 245, which may be detected as one Y-axis edge pattern. Further, the difference between the gradation values of the sixth pixel P6 and the eighth pixel P8 is 245, which may be detected as one Y-axis edge pattern.

As a result, in the embodiment shown in FIG. 10, when the reference gradation value difference is defined as 80% or more of the maximum gradation value, the number of X-axis edge patterns included in the corresponding frame of the first image data ID1 may be defected as two, and the number of Y-axis edge patterns included in the corresponding frame of the first image data ID1 may be defected as four.

In other words, when the first image data ID1 realizing the image shown in FIG. 10 is provided to the X-axis edge counter 2121 and the Y-axis edge counter 2122, the X-axis edge counter 2121 may generate X-axis edge pattern information XEI including information that there are two X-axis edge patterns, and the Y-axis edge counter 2122 may generate Y-axis edge pattern information YEI including information that there are four Y-axis edge patterns.

The image shown in FIG. 10 corresponds to an example image, and the edge analysis unit 212 may detect the X-axis edge pattern and the Y-axis edge pattern in consideration of the number of pixels arranged in the actual display area DA.

Meanwhile, the deterioration of the X-axis edge pattern can be prevented (or reduced) by the image movement in the X-axis X, but is not likely to be prevented (or reduced) by the image movement in the Y-axis direction Y. For example, in the case of the X-axis edge pattern composed of the second pixel P2 and the third pixel P3, it is assumed that the image movement in the X-axis direction X is performed for one pixel unit. In this case, the gradation value of the third pixel P3 is greatly changed from 254 to 0, the deterioration of the X-axis edge pattern can be prevented (or reduced).

However, in the case of the X-axis edge pattern composed of the second pixel P2 and the third pixel P3, when the image movement in the Y-axis direction Y is performed for one pixel unit, the gradation value of the third pixel P3 is only changed from 254 to 250. Therefore, the deterioration prevention (or reduction) effect for the third pixel P3 cannot be expected.

Similarly, the deterioration of the Y-axis edge pattern can be prevented (or reduced) by the image movement in the Y-axis Y, but is not likely to be prevented (or reduced) by the image movement in the X-axis direction X. For example, in the case of the Y-axis edge pattern composed of the fifth pixel P5 and the eighth pixel P8, it is assumed that the image movement in the Y-axis direction Y is performed for one pixel unit. In this case, the gradation value of the fifth pixel P5 is greatly changed from 250 to 5, the deterioration of the X-axis edge pattern can be prevented (or reduced).

However, in the case of the Y-axis edge pattern composed of the fifth pixel P5 and the eighth pixel P8, when the image movement in the X-axis direction X is performed for one pixel unit, the gradation value of the fifth pixel P5 is maintained at 250. Therefore, the deterioration prevention (or reduction) effect for the fifth pixel P5 cannot be expected.

Accordingly, when the edge analysis unit 212 detects the number of X-axis edge patterns and the number of Y-axis edge patterns for each frame and provides this information to the scenario determination unit 213, the scenario determination unit 213 may determine the movement pattern more optimized for deterioration prevention (or reduction) by comparing the number of the X-axis edge patterns and the number of the Y-axis edge patterns. For example, when the number of Y-axis edge patterns is larger than the number of X-axis edge patterns during one frame period, during the next frame period, the scenario determination unit 213 may determine that the image is moved depending on the movement pattern including the number of times of the image movement in the X-axis direction X larger than the number of times of the image movement in the Y-axis direction Y.

Meanwhile, the edge analysis unit 212 may detect the number of X-axis edge patterns and the number of Y-axis edge patterns only for some of the areas of each frame, instead of detecting the number of X-axis edge patterns and the number of Y-axis edge patterns for all of the areas of each frame. In this case, the amount of operation performed by the edge analysis unit 212 is reduced, and thus the generation of the X-axis edge pattern information XEI and the Y-axis edge pattern information YEI can be performed more quickly.

Moreover, the edge analysis unit 212 may detect the number of X-axis edge patterns and the number of Y-axis edge patterns only for some frames, instead of detecting the number of X-axis edge patterns and the number of Y-axis edge patterns for all frames. In this case, the amount of operation performed by the edge analysis unit 212 is reduced, and thus the generation of the X-axis edge pattern information XEI and the Y-axis edge pattern information YEI can be performed more quickly.

Hereinafter, the movement pattern will be described in more detail.

Figure 11:
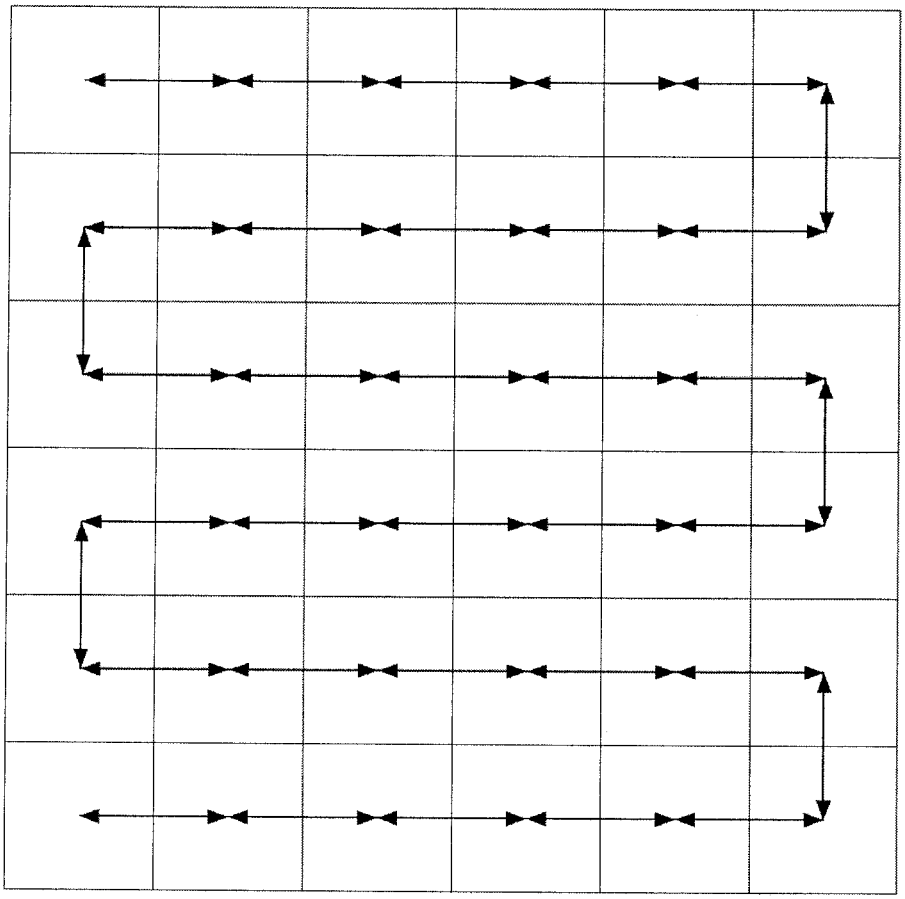
FIG. 11 is a schematic view illustrating a movement pattern of the display device according to some example embodiments of the present invention.
Figure 11:
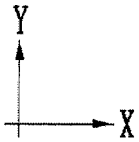

FIG. 11 is a schematic view illustrating the movement pattern of the display device according to an embodiment.

FIG. 11 shows an example case where the display image DI is moved by a pixel area of six rows and six columns. In this case, the areas actually moving in the display area DA correspond to the third area A3 shown in FIGS. 4 and 5 and the sixth area A6 shown in FIGS. 7 and 8. The first area A1 and second area A2 shown in FIGS. 4 and 5 and the fourth area A4 and fifth area A5 shown in FIGS. 7 and 8 may be enlarged or reduced in accordance with the movement of the third area A3 and the sixth area A6, respectively.

Referring to FIG. 11, in the movement pattern according to the embodiment shown in FIG. 11, the display image DI, based on the pixel located at the leftmost end of the display image DI, is moved by five pixels in the X-axis direction X, moved by one pixel in a direction opposite to the Y-axis direction Y, moved by five pixels in a direction opposite to the X-axis direction X, moved by one pixel in a direction opposite to the Y-axis direction Y, moved by five pixels in the X-axis direction X, moved by one pixel in a direction opposite to the Y-axis direction Y, moved by five pixels in a direction opposite to the X-axis direction X, moved by one pixel in a direction opposite to the Y-axis direction Y, moved by five pixels in the X-axis direction X, moved by one pixel in a direction opposite to the Y-axis direction Y, and then moved by five pixels in a direction opposite to the X-axis direction X. Thereafter, the display image DI is moved again in the reverse order of the path moved by the above-described 35 pixels.

Such movement of a total of 70 pixel units may be composed of an image movement of 60 pixel units in the X-axis direction X and an image movement of 10 pixel units in the Y axis direction Y. That is, it may be possible to maximize (or improve) the degree of deterioration prevention (or reduction) for the display image DI including the X-axis edge pattern more than the Y-axis edge pattern.

For example, when the number of X-axis edge patterns is greater than the number of Y-axis edge patterns during a period corresponding to the previous 70 frames, the degree of deterioration prevention (or reduction) for the display image DI can be maximized by using the movement pattern according to this embodiment during a period corresponding to the next 70 frames.

Moreover, in the movement pattern according to this embodiment, the image movement of one pixel unit in the Y-axis direction Y is performed for each image movement of five pixel units in the X-axis direction X, but it goes without saying that the number of these can be changed. For example, the ratio of the number of image movements in the X-axis direction X and the number of image movements in the Y-axis direction Y may be adjusted in proportion to or in a specific function relationship with the number of X-axis edge patterns and Y-axis patterns included during one frame period.

For example, when the number of X-axis patterns is two times the number of Y-axis edge patterns during the one frame period, the number of image movements in the X-axis direction X may be set to be two or four times the number of image movements in the Y-axis direction Y.

Further, as described in this embodiment, the pixel area unit in which the display image DI moves may be changed at any time without being limited to the movement of the display image DI in a pixel area unit of 6 rows and 6 columns.

That is, the movement pattern described in this embodiment corresponds to that of an illustrative embodiment. If the number of image movements in the X-axis direction X is made larger than the number of image movements in the Y-axis direction Y, the movement pattern may be changed at any time.

Figure 12:
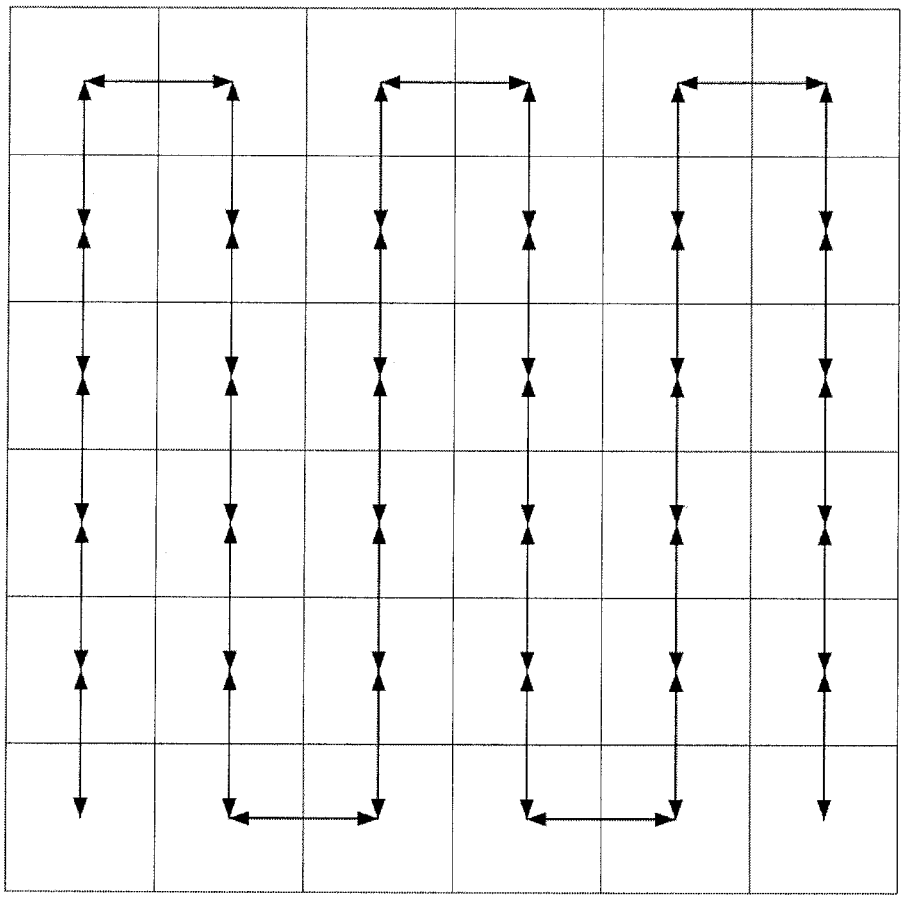
FIG. 12 is a schematic view illustrating a movement pattern of a display device according to some example embodiments of the present invention.
Figure 12:
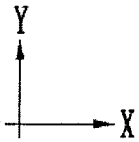

FIG. 12 is a schematic view illustrating the movement pattern of the display device according to another embodiment.

FIG. 12, similar to the embodiment shown in FIG. 11, shows an example case where the display image DI is moved by a pixel area of six rows and six columns. In this case, the areas actually moving in the display area DA correspond to the third area A3 shown in FIGS. 4 and 5 and the sixth area A6 shown in FIGS. 7 and 8. The first area A1 and second area A2 shown in FIGS. 4 and 5 and the fourth area A4 and fifth area A5 shown in FIGS. 7 and 8 may be enlarged or reduced in accordance with the movement of the third area A3 and the sixth area A6, respectively.

Referring to FIG. 12, in the movement pattern according to the embodiment shown in FIG. 12, the display image DI, based on the pixel located at the leftmost end of the display image DI, is moved by five pixels in the Y-axis direction Y, moved by one pixel in the X-axis direction X, moved by five pixels in a direction opposite to the Y-axis direction Y, moved by one pixel in the X-axis direction X, moved by five pixels in the Y-axis direction Y, moved by one pixel in the X-axis direction X, moved by five pixels in a direction opposite to the Y-axis direction Y, moved by one pixel in a direction opposite to the X-axis direction X, moved by five pixels in the Y-axis direction Y, moved by one pixel in the X-axis direction X, and then moved by five pixels in a direction opposite to the Y-axis direction Y. Thereafter, the display image DI is moved again in the reverse order of the path moved by the above-described 35 pixels.

Such movement of a total of 70 pixel units may be composed of an image movement of 10 pixel units in the X-axis direction X and an image movement of 60 pixel units in the Y axis direction Y. That is, it may be possible to maximize (or improve) the degree of deterioration prevention (or reduction) for the display image DI including the Y-axis edge pattern more than the X-axis edge pattern.

Moreover, in the movement pattern according to this embodiment, the image movement of one pixel unit in the X-axis direction X is performed for each image movement of five pixel units in the Y-axis direction Y, but it goes without saying that the number of these can be changed as described in the embodiment shown in FIG. 11.

That is, the movement pattern described in this embodiment corresponds to that of an illustrative embodiment. If the number of image movements in the Y-axis direction Y is made larger than the number of image movements in the X-axis direction X, the movement pattern may be changed at any time.

Hereinafter, a method of generating the second image data ID2 using the first video data ID1 will be described in more detail.

Figure 13:
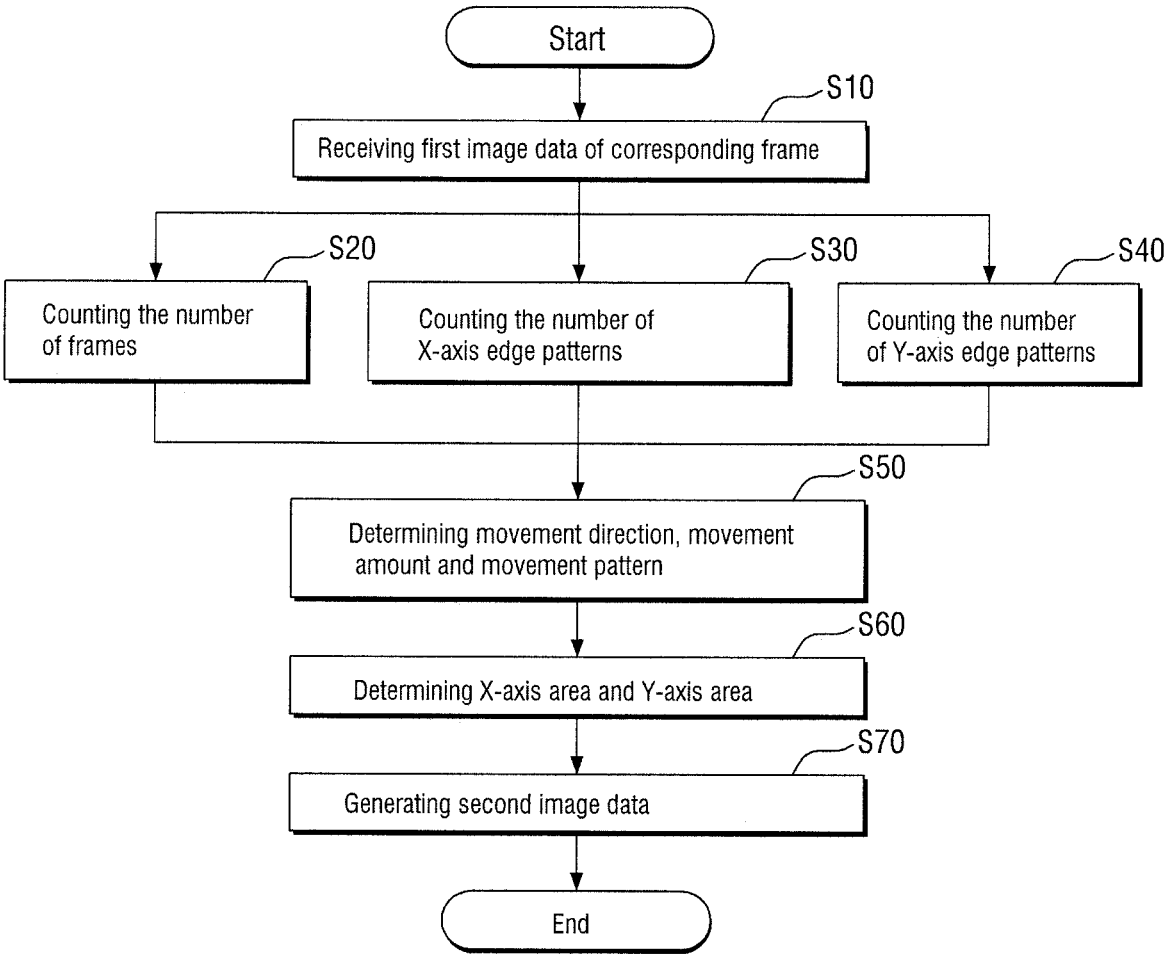
FIG. 13 is a flowchart illustrating a method of generating second image data by the image correction unit of the display device according to some example embodiments of the present invention.

FIG. 13 is a flowchart illustrating a method of generating second image data by the image correction unit of the display device according to an embodiment.

Referring to FIG. 13, first, the frame detection unit 211, the X-axis edge counter 2121, and the Y-axis edge counter 2122 receive first image data ID1 (S10).

Next, the frame detection unit 211 detects the number of frames, generates frame information FI including information about these frames, and provides the frame information FI to the scenario determination unit 213 (S20). Independently thereto, the X-axis edge counter 2121 detects the number of X-axis edge patterns included in the corresponding frame period, generates X-axis edge pattern information XEI including information about these X-axis edge patterns, and provides the X-axis edge pattern information XEI to the scenario determination unit 213 (S30). Further, the Y-axis edge counter 2122 detects the number of Y-axis edge patterns included in the corresponding frame period, generates Y-axis edge pattern information YEI including information about these Y-axis edge patterns, and provides the Y-axis edge pattern information YEI to the scenario determination unit 213 (S40).

Next, the scenario determination unit 213 generates image movement direction information MDI including information about the movement direction of the display image DI, image movement amount information MAI including information about the movement amount of the display image DI, and image movement pattern information MPI including information about the movement pattern of the display image DI using the received frame information FI, X-axis edge pattern information XEI and Y-axis edge pattern information YEI, and provides these image movement direction information MDI, image movement amount information MAI and image movement pattern information MPI to the area determination unit 214 (S50).

Next, the area determination unit 214 generates X-axis area information XAI and Y-axis area information YAI using the received image movement direction information MDI, image movement amount information MAI and image movement pattern information MPI (S60).

Next, the image data generation unit 215 generates second image data ID2 using the received X-axis area information XAI and Y-axis area information YAI (S70).

Figure 14:
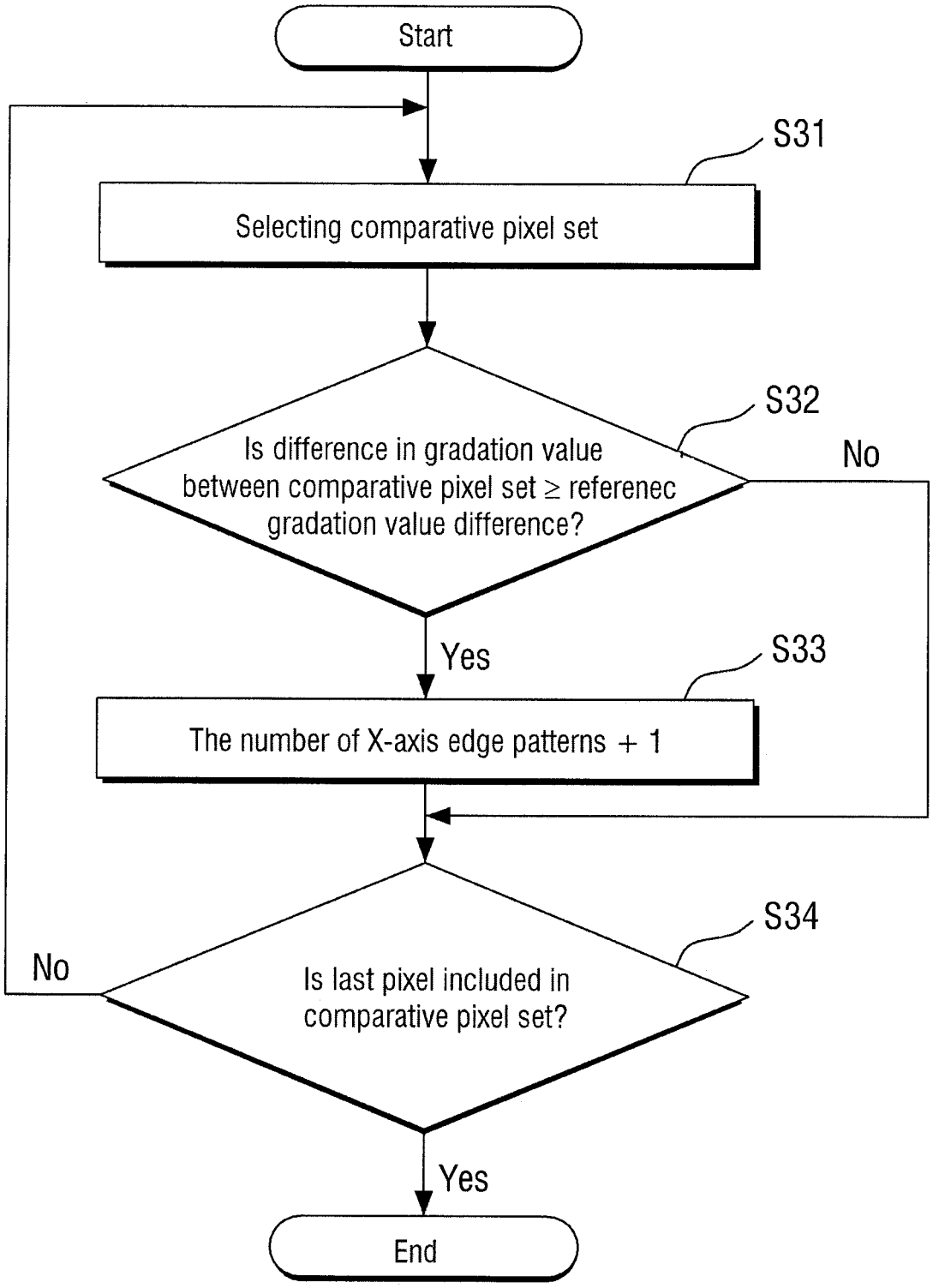
FIG. 14 is a flowchart illustrating a method of detecting an X-axis edge pattern using an X-axis edge counter.

FIG. 14 is a flowchart illustrating a method of detecting the X-axis edge pattern using the X-axis edge counter.

Referring to FIG. 14, a comparative pixel set for the corresponding frame is selected (S31). For example, assuming that the image shown in FIG. 10 is input, the first pixel P1 and the second pixel P2 are selected as the comparative pixel set.

Next, it is determined whether the difference in gradation value between the comparative pixel sets is equal to or greater than the reference gradation value difference (S32).

As the result of determination, when the difference in gradation value between the comparative pixel sets is equal to or greater than the reference gradation value difference, the number of X-axis edge patterns is counted by one, and when the difference in gradation value between the comparative pixel sets is less than the reference gradation value difference, the next step proceeds (S33).

Next, it is determined whether the last pixel of the corresponding frame is included in the comparative pixel set (S34). As the result of determination, when the last pixel of the corresponding frame is not included in the comparative pixel set, the next comparative pixel set is selected, and when the last pixel of the corresponding frame is included in the comparative pixel set, the detection of the number of edge patterns in the X-axis direction X for the corresponding frame ends. For example, assuming that the image shown in FIG. 10 is input, when the ninth pixel P9 is selected as one of the comparative pixel sets, the detection of the number of edge patterns in the X-axis direction X may end.

The method of detecting the number of Y-axis edge patterns may be performed in the same manner as the method of detecting the number of X-axis edge patterns, and some repetitive description thereof will be omitted.

Figure 15:
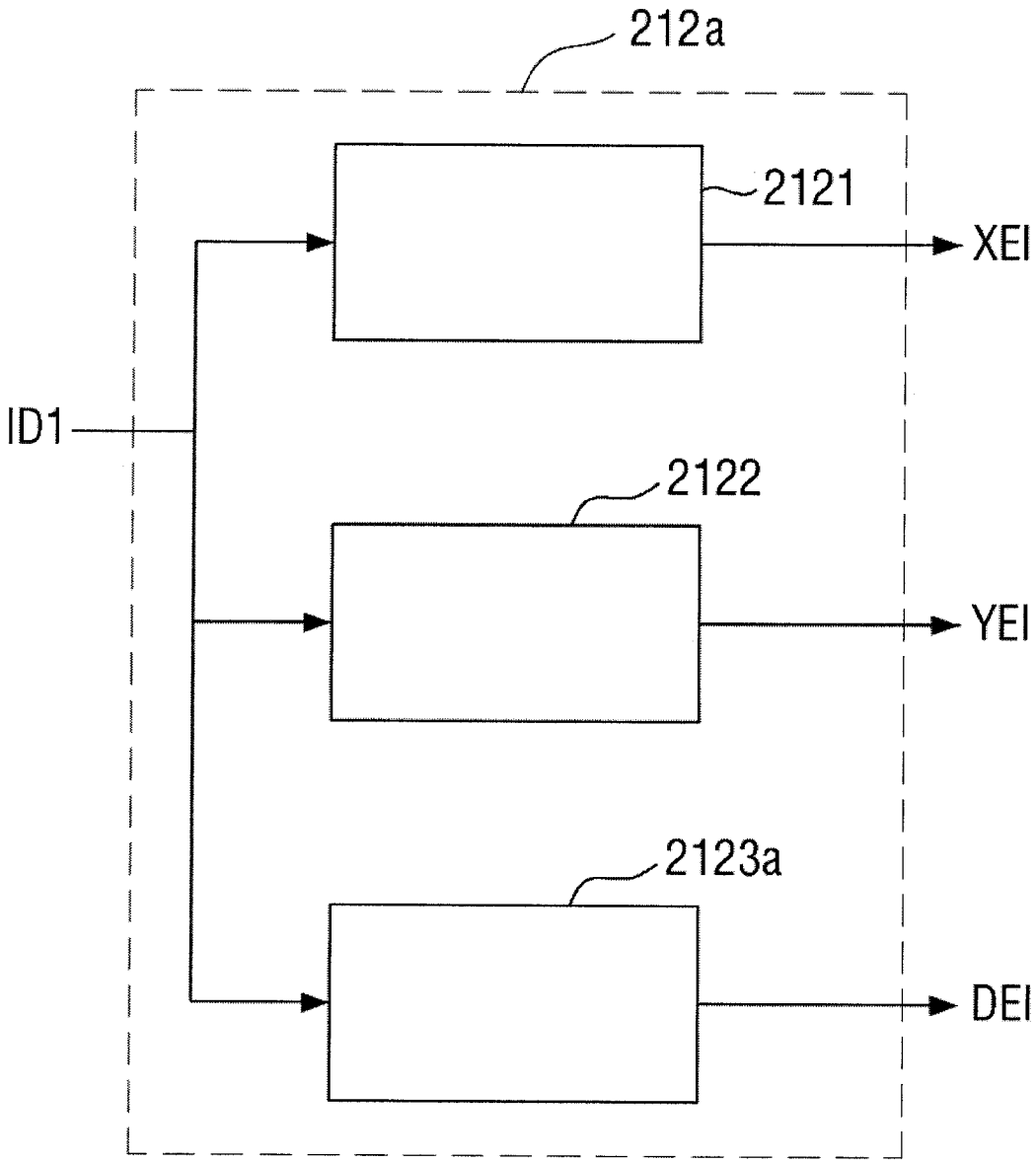
FIG. 15 is a block diagram of an edge analysis unit according to some example embodiments of the present invention.

FIG. 15 is a block diagram of an edge analysis unit according to another embodiment.

Referring to FIG. 15, an edge analysis unit 212*a* includes an X-axis edge counter 2121, a Y-axis edge counter 2122, and a diagonal edge counter 2123*a*. Here, because the X-axis edge counter 2121 and the Y-axis edge counter 2122 have been described through the embodiment shown in FIG. 2, a description thereof will be omitted.

The diagonal edge counter 2123*a* may detect the number of diagonal edge patterns included in each frame, generate diagonal edge pattern information including information about this, and provide the diagonal edge pattern information to the scenario determination unit 213.

Here, the "diagonal direction" corresponds to a direction in which two pixels spaced apart from each other by one pixel unit in the X-axis direction and the Y-axis direction. That is, the diagonal direction may be a direction toward the right upper end or a direction toward the right lower end.

Illustratively, it is assumed that the display image DI provided to the diagonal edge counter 2123*a* is the display image DI according to the embodiment shown in FIG. 10.

In this case, the difference between the gradation values of the second pixel P2 and the fourth pixel P4 is 250, which may be detected as one diagonal edge pattern. Further, the difference between the gradation values of the fifth pixel P5 and the seventh pixel P7 is 245, which may be detected as one diagonal edge pattern. Further, the difference between the gradation values of the sixth pixel P6 and the eighth pixel P8 is 245, which may be detected as one diagonal edge pattern. Further, the difference between the gradation values of the second pixel P2 and the sixth pixel P6 is 250, which may be detected as one diagonal edge pattern. Further, the difference between the gradation values of the fourth pixel P4 and the eighth pixel P8 is 245, which may be detected as one diagonal edge pattern. Further, the difference between the gradation values of the fifth pixel P5 and the ninth pixel P9 is 245, which may be detected as one diagonal edge pattern. That is, the number of diagonal edge patterns included in the display image DI according to the embodiment shown in FIG. 10 may be detected as six.

Figure 16:
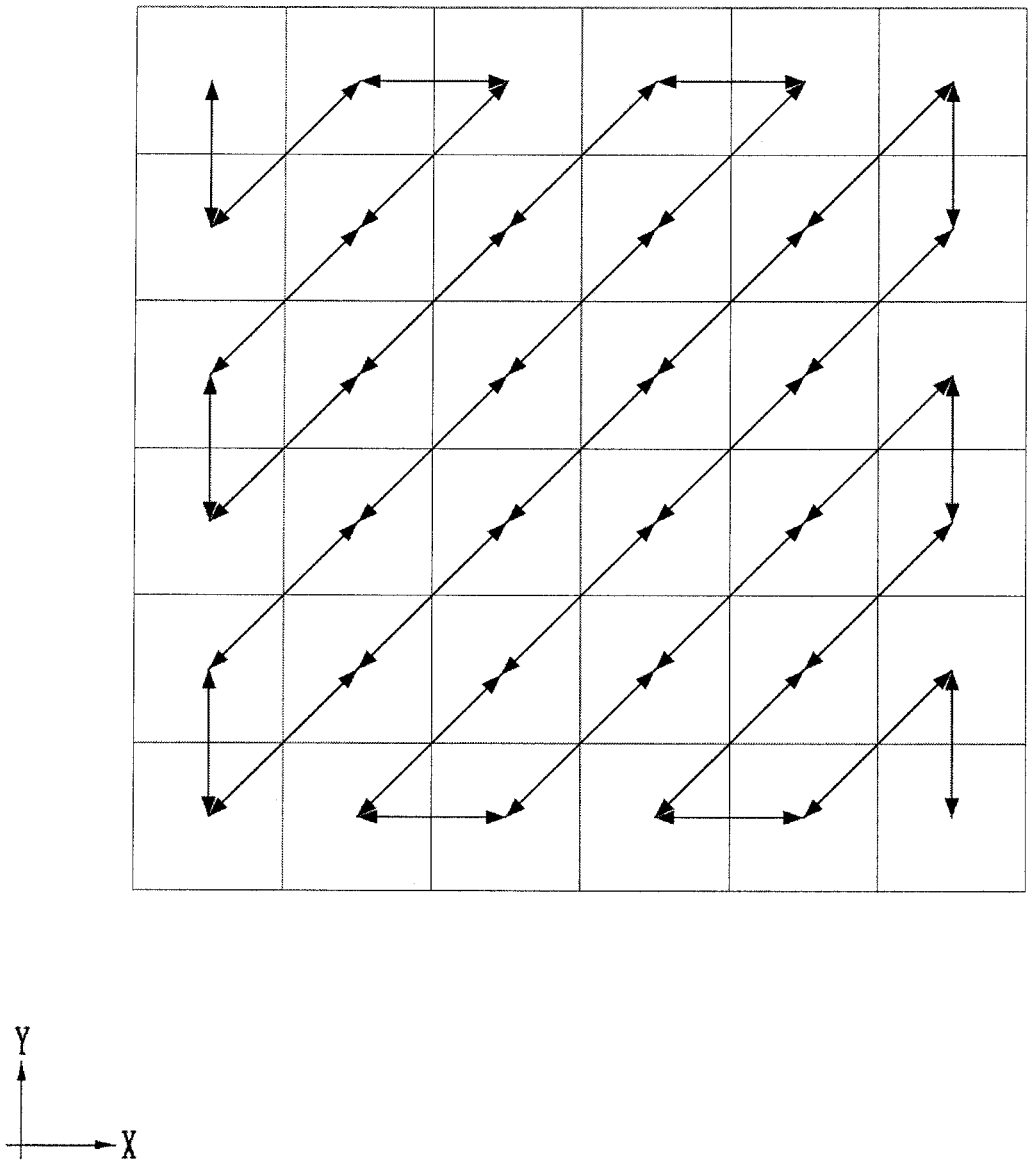
FIG. 16 is a schematic view showing a movement pattern of a display device according to some example embodiments of the present invention.

FIG. 16 is a schematic view showing the movement pattern of a display device according to another embodiment.

FIG. 16, similarly to the embodiment shown in FIG. 11, shows an example case where the display image DI is moved by a pixel area of six rows and six columns. In this case, the areas actually moving in the display area DA correspond to the third area A3 shown in FIGS. 4 and 5 and the sixth area A6 shown in FIGS. 7 and 8. The first area A1 and second area A2 shown in FIGS. 4 and 5 and the fourth area A4 and fifth area A5 shown in FIGS. 7 and 8 may be enlarged or reduced in accordance with the movement of the third area A3 and the sixth area A6, respectively.

Referring to FIG. 16, in the movement pattern according to the embodiment shown in FIG. 16, the display image DI, based on the pixel located at the leftmost upper end of the display image DI, is moved by one pixel in a direction opposite to the Y-axis direction Y, is moved by one pixel in the diagonal direction, moved by one pixel in the X-axis direction X, moved by two pixels in the diagonal direction, moved by one pixel in a direction opposite to the Y-axis direction Y, moved by three pixels in the diagonal direction, moved by one pixel in the X-axis direction X, moved by four pixels in the diagonal direction, moved by one pixel in a direction opposite to the Y-axis direction Y, moved by five pixels in the diagonal direction, moved by one pixel in a direction opposite to the Y-axis direction Y, moved by four pixels in the diagonal direction, moved by one pixel in the X-axis direction X, moved by three pixels in the diagonal direction, moved by one pixel in a direction opposite to the Y-axis direction Y, moved by two pixels in the diagonal direction, moved by one pixel in the X-axis direction X, moved by one pixel in the diagonal direction, and then moved by one pixel in a direction opposite to the Y-axis direction Y. Thereafter, the display image DI is moved again in the reverse order of the path moved by the above-described 35 pixels.

Such movement of a total of 70 pixel units may be composed of an image movement of 50 pixel units in the diagonal direction, an image movement of 8 pixel units in the X-axis direction X, and an image movement of 12 pixel units in the Y axis direction Y. That is, it is possible to maximize the degree of deterioration prevention (or reduction) for the display image DI including the diagonal edge pattern more than the X-axis edge pattern and the Y-axis edge pattern.

However, the movement pattern described in this embodiment corresponds to that of an illustrative embodiment. If the number of image movements in the diagonal direction is made larger than the number of image movements in the X-axis direction X and the number of image movements in the Y-axis direction Y, the movement pattern may be changed at any time.

As described above, according to the embodiments of the present invention, there is provided a display method in which an image is variably moved in accordance with the image in order to maximize the degree of prevention (or reduction) of deterioration of pixels.

Further, there is provided a display method in which an image is variably moved in accordance with the image in order to maximize the degree of prevention (or reduction) of deterioration of pixels.

The effects of the present invention are not limited by the foregoing, and other various effects are anticipated herein.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments of the present invention.

Although the example embodiments of the present invention have been disclosed for illustrative purposes, those skilled in the art will appreciate that various modifications, additions and substitutions are possible, without departing from the scope and spirit of the invention as disclosed in the accompanying claims, and their equivalents.

What is claimed is:

1. A display device, comprising:

a display panel including a plurality of pixels and configured to display an image; and a display driver configured to drive the display panel, such that the image includes at least one X-axis edge pattern in which a difference between gradation values of the two pixels adjacent to each other in an X-axis direction is equal to or greater than a reference gradation value difference, and at least one Y-axis edge pattern in which a difference between gradation values of the two pixels adjacent to each other in a Y-axis direction is equal to or greater than the reference gradation value difference, and a degree of movement of some areas of the image in the X-axis direction is greater than a degree of movement of some areas of the image in the Y-axis direction in response to a number of the X-axis edge patterns included in the image being larger than a number of the Y-axis edge patterns included in the image.

2. A display device, comprising:

a display panel including a plurality of pixels; and a display driver configured to:

receive input image data and to generate output image data;

analyze the input image data to detect an X-axis edge pattern and a Y-axis edge pattern of an input image;

determine a movement pattern of the input image in response to a number of the X-axis edge patterns and a number of the Y-axis edge patterns; and generate output image data of an output image in which some areas of the input image are moved according to the movement pattern, wherein the X-axis edge pattern is a pattern in which a difference between gradation values of two pixels adjacent to each other in an X-axis direction is equal to or greater than a reference gradation value difference, and wherein the Y-axis edge pattern is a pattern in which a difference between gradation values of two pixels adjacent to each other in a Y-axis direction is equal to or greater than a reference gradation value difference.

3. The display device of claim 2, wherein the reference gradation value difference corresponds to 80% of a maximum gradation value.

4. The display device of claim 2, wherein a degree of movement of the output image in the X-axis direction according to the movement pattern and a degree of movement of the output image in the Y-axis direction according to the movement pattern correspond to a number of X-axis edge patterns in the input image and a number of Y-axis patterns in the input image, respectively.

5. The display device of claim 4, wherein the degree of movement of the output image in the X-axis direction according to the movement pattern is greater than the degree of movement of the output image in the Y-axis direction according to the movement pattern when the number of the X-axis edge patterns in the input image is larger than the number of the Y-axis edge patterns in the input image.

6. The display device of claim 4, wherein the degree of movement of the output image in the Y-axis direction according to the movement pattern is greater than the degree of movement of the output image in the X-axis direction according to the movement pattern when the number of the Y-axis edge patterns in the input image is larger than the number of the X-axis edge patterns in the input image.

7. The display device of claim 2, wherein the display driver is further configured to analyze the input image data to detect a number of frames of the input image.

8. The display device of claim 7, wherein the display driver is further configured to determine a lookup table according to the number of the frames, and to determine a movement direction and a movement amount of the input image using values included in the lookup table.

9. The display device of claim 2, wherein the input image and the output image have a same size.

10. The display device of claim 2, wherein the output image is an image in which a first area of the input image is enlarged, a second area thereof is reduced, and a third area thereof is moved.

11. The display device of claim 10, wherein the output image is an image in which the third area moves from the first area toward the second area.

12. The display device of claim 2, wherein the display driver is further configured to detect an X-axis edge pattern and a Y-axis edge pattern only in some areas of the input image.

13. The display device of claim 2, wherein the display driver is further configured to detect an X-axis edge pattern and a Y-axis edge pattern only in some frames of the input image.

14. The display device of claim 2, wherein the display driver is further configured to detect a diagonal edge pattern of the input image.

15. The display device of claim 14, wherein the diagonal edge pattern is a pattern in which a difference between gradation values of two pixels adjacent to each other in a diagonal direction is equal to or greater than a reference gradation value difference.

16. A display method, comprising:

analyzing input image data to detect an X-axis edge pattern and a Y-axis edge pattern of an input image;

determining a movement pattern of the input image in response to a number of the X-axis edge patterns and a number of the Y-axis edge patterns; and generating output image data of an output image in which some areas of the input image are moved according to the movement pattern, wherein the X-axis edge pattern is a pattern in which a difference between gradation values of two pixels adjacent to each other in an X-axis direction is equal to or greater than a reference gradation value difference, and wherein the Y-axis edge pattern is a pattern in which a difference between gradation values of two pixels adjacent to each other in a Y-axis direction is equal to or greater than a reference gradation value difference.

17. The display method of claim 16, wherein the detecting of the X-axis edge pattern includes:

selecting a comparative pixel set;

determining whether a difference in gradation vales between the comparative pixel sets is equal to or greater than a reference gradation value difference;

counting the number of the X-axis edge patterns when the difference in gradation vales between the comparative pixel sets is equal to or greater than the reference gradation value difference; and determining whether or not the last pixel is included in the comparative pixel set.

18. The display method of claim 17, wherein the reference gradation value difference corresponds to 80% of a maximum gradation value.

* * * * *